US005887048A

United States Patent [19]

Sata et al.

[11] Patent Number: 5,887,048

[45] Date of Patent: Mar. 23, 1999

[54] X-RAY REFLECTING DEVICE

[75] Inventors: Toshio Sata; Tamio Hara; Naohiro Yamaguchi, all of Nagoya, Japan

[73] Assignees: Toyota Jidosha Kabushiki Kaisha, Toyota; Toyota School Foundation, Nagoya; Denso Corporation, Kariya, all of Japan

[21] Appl. No.: 848,069

[22] Filed: Apr. 28, 1997

[30] Foreign Application Priority Data

Apr. 30, 1996 [JP] Japan ..... 8-109419

[51] Int. Cl.[6] ..... G21K 1/06

[52] U.S. Cl. ..... 378/84; 378/82

[58] Field of Search ..... 378/82, 84

[56] References Cited

U.S. PATENT DOCUMENTS

| | | | |
|---|---|---|---|
| 2,543,630 | 2/1951 | Hansen | 378/84 |
| 2,853,617 | 9/1958 | Berreman | 378/84 |
| 4,625,323 | 11/1986 | Okaya | 378/82 |
| 5,080,739 | 1/1992 | Fernandez et al. . | |

FOREIGN PATENT DOCUMENTS

| | | |
|---|---|---|
| 53-022750 | 3/1978 | Japan . |
| 59-019646 | 2/1984 | Japan . |
| 1138563 | 9/1989 | Japan . |
| 4354668 | 12/1992 | Japan . |
| 5-297197 (A) | 11/1993 | Japan . |
| 8-101300 (A) | 4/1996 | Japan . |

*Primary Examiner*—Craig E. Church
*Attorney, Agent, or Firm*—Kenyon & Kenyon

[57] ABSTRACT

A reflecting mirror of an X-ray reflecting device is produced by a spherical surface machining method, and when the device is used, a desired aspherical reflecting surface can be obtained by elastically deforming the mirror with application of an external force. The device has the mirror 11 and a support member 17. The mirror 11 is made of elastically deformable material. A surface 11*a* of the mirror 11 is finished by the spherical surface machining method. When the device is used, pressure is applied against a rear surface 11*b* of the mirror 11 and the mirror 11 is deformed into a desired aspherical shape.

9 Claims, 1 Drawing Sheet

X-RAY REFLECTING DEVICE

BACKGROUND OF THE INVENTION

1. Field of the Invention

This invention relates to an X-ray reflecting device in which a reflecting mirror is produced by a spherical surface machining method, and in which when the device is used, a desired aspherical reflecting surface can be obtained by elastically deforming the mirror with application of an external force.

2. Description of the Prior Art

A reflecting mirror with a spherical surface is easy to produce, but when used for condensing light, the spherical mirror cannot focus the light on a spot and causes spherical aberration. In order to eliminate the spherical aberration, it is preferable to use a reflecting mirror with an aspherical reflecting surface such as parabolic surface. However, it is difficult to finish the reflecting surface into a smooth aspherical shape.

In a finishing method used at present to obtain the aspherical surface, cutter movement is numerically controlled. However, in this method, the cutter movement is controlled in a stepping manner so that only an approximate aspherical surface is obtained, even if the cutter-feeding resolution is minimized. There is another machining method in which the aspherical surface is formed by cutting or grinding a material with an aspherical surface generator. However, in the last step of this method, polishing is required to finish an aspherical surface in the same manner as that in the numerical controlling. Another method has been known in which a material is machined with a spherical surface lathe, a spherical surface generator, or a spherical surface lap, and the machined spherical surface is polished into an aspherical surface.

Performance of such a reflecting device is evaluated by its reflectance and shape accuracy. Normally, allowable shape accuracy varies with light wavelengths, and requires about one-tenth the light wavelength $\lambda$. In a case of, for example, soft X-ray, wavelength thereof ranges from about 5 to 50 nm. Therefore, the shape accuracy required to the reflecting mirror is 1 nm or less.

It is difficult to obtain such a high shape accuracy as required to an X-ray reflecting mirror by any of above described conventional machining methods. Thus, an X-ray aspherical reflecting mirror has not been put to practical use. It may be possible to gradually enhance the shape accuracy by repeatedly performing a shape modifying step. However, for most applications, this method is not practical since much time and high cost are required to manufacture the device.

SUMMARY OF THE INVENTION

It is, accordingly, an object of the present invention to realize an X-ray reflecting device having an aspherical reflecting surface of a high shape accuracy. According to the present invention, a spherical reflecting mirror is fabricated by a spherical surface machining method by which a high shape accuracy is readily obtained, and then the spherical surface is deformed into an aspherical surface when the device is used.

The X-ray reflecting device according to the present invention comprises a reflecting mirror and a support member. The reflecting mirror is made of elastically deformable material. One surface of the mirror is machined into a spherical surface treated to assure high X-ray reflectance.

The support member supports a periphery of the reflecting mirror. On the periphery or on a rear surface of the reflecting mirror, an external force applying member is provided.

With this construction, when the external force is applied, the mirror is elastically deformed. Thus, the spherical reflecting surface fabricated by the spherical surface machining method is formed into a desired aspherical shape.

The present invention will be more fully understood from the following detailed description and appended claims when taken with the accompanying drawings.

DETAILED DESCRIPTION OF THE PREFERRED EMBODIMENTS (A First Embodiment)

Figure 1:
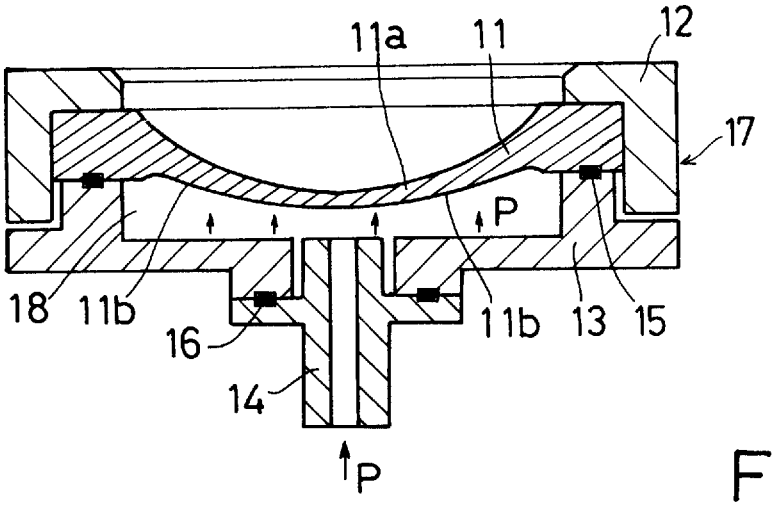
FIG. 1 is a cross-sectional view of an X-ray reflecting device of a first embodiment of the present invention.

FIG. 1 shows a first embodiment of the present invention which comprises a reflecting mirror 11 and a support member 17. The reflecting mirror 11 is formed of an elastically deformable material, and preferably, is formed of a uniform material having an excellent machining property and containing less foreign matter and less deficiency, and being less susceptible to aged deterioration. Oxygen free copper, $SiO_2$, SiC and the like are suitable for the material, but the material is not limited to these examples. One surface 11*a* of the material is precisely finished into a spherical surface by a spherical surface machining method. There is no particular restriction as to which method is used for the spherical surface machining, and cutting by a simple grain diamond of a precision lathe, precision grinding by a spherical surface generator and the like are used. The spherical surface is preferably finished up by random polishing of Osker-type spherical surface polishing method and other methods. In case of finishing up reflecting surfaces, a higher shape accuracy is obtained by the spherical surface machining than a shape accuracy obtained by the aspherical surface machining. Further, in case of polishing the reflecting surfaces, a finer surface roughness can be obtained by the spherical surface polishing than a surface roughness obtained by the aspherical surface polishing.

The rear surface 11*b* of the reflecting mirror 11 is machined into an aspherical shape by a numerically-controlled cutting machine or grinding machine. The rear surface 11*b* is allowed to be machined by the normal numerical controller, since it does not require very high shape accuracy or very fine surface roughness. The shape of the rear surface 11*b* determines the thickness of the reflecting mirror 11. By thus machining the rear surface 11*b* into the aspherical shape, the radial thickness of the reflecting mirror 11 is non-uniformly distributed. Therefore, when the rear surface 11*b* is applied with a uniform external force, the reflecting mirror 11 is non-uniformly deformed, thus forming the reflecting surface 11*a* into an aspherical shape.

The radial distribution of the mirror thickness or the shape of the rear surface 11*b* is calculated based on a finite element method or other calculation methods. In this case, when the uniform pressure acts on the rear surface 11*b*, an elastically deforming manner of the rear surface 11*b* is taken into the calculation step, and based on which the shape of the rear surface 11*b* is predetermined so that the shape of the elastically deformed reflecting surface 11*a* may accord with a shape of a designed aspherical surface. The rear surface 11*b* is machined into the predetermined shape by the numerical controller. The step-like cutter-feed peculiar to the numerical controller arouses no problem for the rear surface 11*b* since the accuracy required to the rear surface 11*b* is lower than that required to the reflecting surface 11*a*.

It is also possible to obtain the non-uniform radial thickness of the mirror 11 by finishing both the reflecting surface 11*a* and the rear surface 11*b* into spherical shapes with their centers off. With this construction, the deformed reflecting surface may be formed into a desired aspherical shape. In this case, machining property may be increased since the rear surface can also be machined into a spherical surface. Further, the applied external force can be non-uniformly distributed in the radial direction of the mirror 11 with the mirror thickness maintained to be uniform, as will be described hereinafter. In this case, both the reflecting surface 11*a* and the rear surface 11*b* of the mirror 11 are machined into spherical surfaces having the same centers, thus further facilitating the machining.

The spherically machined reflecting surface 11*a* of the reflecting mirror 11 is treated to assure a high X-ray reflectance. In this embodiment, an X-ray reflecting film is formed. As a reflecting film, films of heavy metals such as Au and Pt are coated by a gaseous phase coating method designated by EB vapor deposition or spattering. When a material is spherically machined and polished and then coated with the heavy metal film, a surface roughness of 1 nm or less is relatively readily obtained. With this construction, a sufficient X-ray reflectance is assured. The reflecting mirror thus obtained is entirely different from the mirror formed by the aspherical surface machining. In order to obtain a reflecting mirror of high light-condensing efficiency, the mirror is preferably multi-layered. With the multi-layer coating, a reflectance relative to an X-ray having a specific incidence angle and a specific wavelength is remarkably improved. As a multi-layered film, Mo, Si, $B_4C$, RhRu-C and the like are preferable. The treatment for assuring X-ray reflectance is not limited to the above described one, and any known method may be used.

A support member 17 of FIG. 1 is comprised of a ring-like member 12 having a short coaxial cylinder on its outer periphery and a disc-like member 13 having a short coaxial cylinder at a radially inward position thereof. The ring-like member 12 is connected to the disc-like member 13 by a screw (not shown). The ring-like member 12 restricts the top periphery of the reflecting mirror 11 while the short cylinder of the ring-like member 12 restricts the outer periphery of the reflecting mirror 11. The top periphery of the inward cylinder of the disc-like member 13 restricts the bottom periphery of the reflecting mirror 11. Thus, the support member 17 secures the surroundings of the reflecting mirror 11.

A through hole is provided at the center of the disc-like member 13 to which a flange 14 is fixed by a screw (not shown). The flange 14 has a through hole along its axis so that a hydraulic or pneumatic pressure P can be applied to the rear surface 11*b* of the reflecting mirror 11 via the through hole from the outside thereof. Numerals 15 and 16 are O-rings provided to prevent a pressurizing medium from leaking from a pressurizing chamber 18 surrounded by the rear surface 11*b* of the reflecting mirror 11, the disc-like member 13 and the flange 14. The above method of pressurizing the chamber 18 may be replaced by an application method of Pascal's principle.

In this embodiment, the reflecting mirror 11 is used while the pressurizing chamber 18 is under a predetermined pressure. In this case, distribution of the mirror thickness is calculated in advance. When pressure acts uniformly on the rear surface 11*b*, the reflecting mirror 11 non-uniformly deforms in the radial direction to form a desired aspherical shape. When a parallel X-ray enters the mirror 11 under the above condition, the X-ray can be focused on a spot by the aspherical shape of the reflecting surface without producing spherical aberration.

Besides focusing the parallel X-ray on a spot, there are some cases in which the X-ray is required to be condensed to have a long linear cross-section. These cases can be overcome if the distribution of the mirror thickness is varied in a circumferential direction. Specifically, when supposing perpendicularly intersecting X- and Y- axes in a plan view of the reflecting mirror 11, the mirror thickness along the X-axis is made thicker than that along the Y-axis so that it becomes difficult to deform the mirror in the X-axis direction and easy to deform in the Y-axis direction. With this construction, an aspherical shape of rotation asymmetry is obtained, thus making it possible to produce an X-ray beam having an aspect ratio in a section perpendicular to a light traveling direction is not 1:1. A pattern of mirror thickness distribution in the circumferential direction is not limited to the above described one, and can be designed in various ways depending on the required beam profiles.

In this embodiment, the reflecting surface 11*a* is machined into the spherical surface without adding elastic deformation, and is then elastically deformed when the device is used. On the other hand, there is a method in which the mirror is spherically machined under a condition that the mirror material is elastically deformed by applying an external force which will then be released when the mirror is used. The device according to this embodiment has an easier machining construction than the machining construction of the latter method. For example, it is much easier to control the temperature of the reflecting mirror under machining process to a desired level while the reflecting mirror under machining process is free from the external force. As a result, an excellent reflecting device can be more readily fabricated. Further, by the method in which the external force is applied to the reflecting mirror when the reflecting device is used, a state in which the external force is applied to the mirror can be feed-back controlled such that a reflected light path measured may conform to a designed light path. This feed-back control cannot be realized by the conventional method.

(A Second Embodiment)

Figure 2:
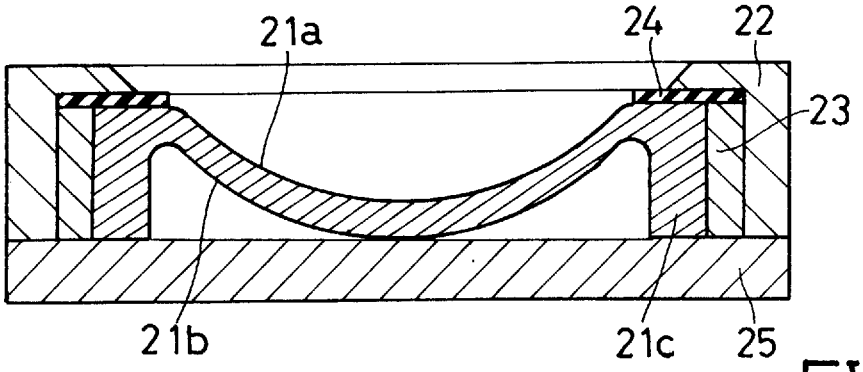
FIG. 2 is a cross-sectional view of an X-ray reflecting device of a second embodiment of the present invention.

FIG. 2 shows a second embodiment of the present invention. Also in this embodiment, a surface 21*a* of a reflecting mirror 21 is formed by a spherical surface machining method, while a rear surface 21*b* is formed by an aspherical surface machining method such that the mirror thickness is non-uniformly distributed. The descriptions of the reflecting mirror of the first embodiment are applied to those of the reflecting mirror 21. A cylindrical flange 21*c* is formed around the outer periphery of the mirror 21 of the second embodiment. Numerals 22 and 25 are support members which are fixed together by a screw (not shown) to secure the surroundings of the reflecting mirror 21.

A ring-like piezoelectric element 23 is arranged between the inner periphery of the cylindrical ring-like support member 22 and the flange 21*c* of the reflecting mirror 21. A pair of electrodes are provided on the top and bottom surfaces of the piezoelectric element 23. When a positive voltage is applied to the top electrode, the radial thickness of the piezoelectric element 23 is increased, and when a negative voltage is applied, the radial thickness of the piezoelectric element 23 is reduced. In association with this deformation, the thickness of the piezoelectric element 23 in a vertical direction is deformed. In order to absorb the vertical deformation, a rubber layer 24 is interposed between the top surface of the piezoelectric element 23 and the bottom surface of the ring-like member 22.

This device is assembled while the outer diameter of the ring-like piezoelectric element 23 is reduced by applying the negative voltage to the top electrode of the ring-like piezoelectric element 23. By thus assembling the device, a radial clearances are not produced between the reflecting mirror 21 and the piezoelectric element 23 and between the piezoelectric element 23 and the ring-like member 22. However, the device may be assembled without applying the voltage.

When the device is used, the peripheral flange 21*c* of the reflecting mirror 21 is compressed in a radially inward direction of the mirror by applying the positive voltage to the top electrode of the ring-like piezoelectric element 23. Thus, the reflecting mirror 21 is elastically deformed more deeply. As same with the first embodiment, the reflecting surface 21*a* is designed in advance by the finite element method such that the deformed surface 21*a* may conform to a desired aspherical shape. Thus, in this state, an X-ray reflecting mirror with a desired aspherical surface is realized.

The value of the positive voltage to be applied to the piezoelectric element 23 is calibrated beforehand. If heat deformation may adversely affect the shape accuracy, the applied voltage should be detected for each temperature condition. By controlling the applied voltage depending on the temperatures, a desired aspherical shape can be obtained regardless of the temperatures. Further, the applied voltage can be feed-back-controlled by comparing the reflected light path with the predetermined light path, thus permitting active control of the applied voltage.

In the above described example, a uniform external force is applied around the outer periphery of the mirror by using the ring-like piezoelectric element 23. In place of the element 23, four piezoelectric elements each being separately controllable can be disposed, for example, on the outer periphery of the reflecting mirror 21. In this case, for example, the voltage is applied to only the two elements along the X-axis so that an aspherical surface is obtained along the X-axis and a spherical surface is obtained along the Y-axis. Further, it is possible that one of the two elements along the X-axis is negatively energized and the other element is positively energized to parallel-displace the reflecting mirror 21 in the X-axis direction. Two or more arbitrary numbers of the piezoelectric elements may be disposed around the periphery of the reflecting mirror.

Another piezoelectric element may be disposed at the center of the rear surface of the reflecting mirror 21. With this construction, an external force applied to the outer periphery of the mirror and an external force applied from the center of the rear surface of the mirror can be arbitrarily controlled. Thus, the spherical mirror with uniform thickness can be deformed by the external forces to be adjusted to an aspherical shape. The reflecting mirror with a uniform thickness has an advantage of ready manufacture.

(A Third Embodiment)

Figure 3:
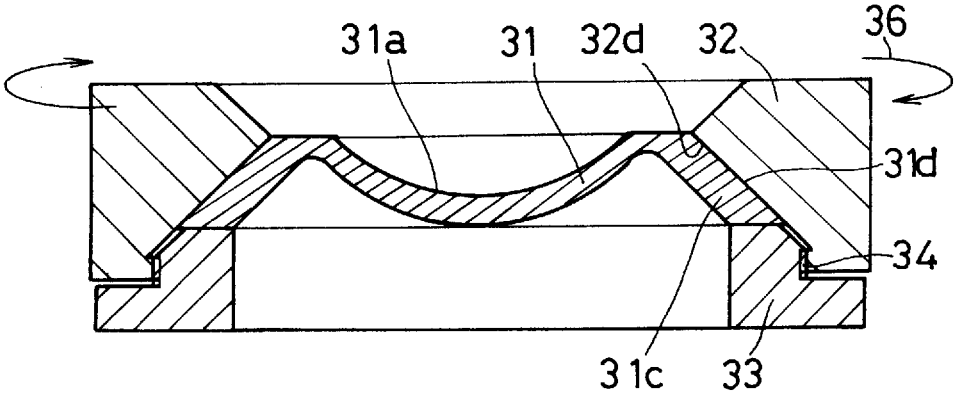
FIG. 3 is a cross-sectional view of an X-ray reflecting device of a third embodiment of the present invention.

FIG. 3 shows a third embodiment of the present invention in which a declined flange 31*c* is formed on a periphery of a reflecting mirror 31. The top surface 31*d* of the flange 31*c* is tapered. Numerals 32 and 33 show support members which are fixed to each other by a screw 34. A surface 32*d* of the upper support member 32 on the mirror side is tapered at the same angle as that of the tapered surface 31*d* of the reflecting mirror 31, and the surfaces arc in contact with each other.

The lower support member 33 is fixed to the upper support member 32 while the reflecting mirror 31 is interposed between the support members 32 and 33. Then, by rotating the upper support member 32 as shown by arrows 36, the screw 34 is engaged and the reflecting mirror 31 is secured via the flange 31*c* by the support members 32 and 33.

When the upper support member 32 is strongly rotated, an external force acts on the flange 31*c* of the reflecting mirror 31 in a downward direction. The reflecting mirror is elastically deformed by the external force. Thickness of the reflecting mirror 31 is so designed beforehand that the mirror 31 is deformed into a desired aspherical shape when the predetermined external force acts on the mirror. A reflecting surface 31*a* of the reflecting mirror 31 is gradually deformed into an aspherical shape during the strong rotation of the support member 32. The support member 32 continues to be rotated until the aspherical shape is obtained. In order to detect whether the above condition is obtained or not, a position where the X-ray is condensed, a size of the condensed light, a reflected light path or a depth of the reflecting surface should be measured.

Also in the third embodiment, the mirror thickness in the circumferential direction can be left non-uninform. With this construction, the mirror is adjusted to be an aspherical surface of rotation asymmetry (for example, toroidal shape).

According to the present invention, the reflecting mirror can be elastically deformed into an aspherical shape during its operation while the reflecting surface of the mirror is machined by a spherical surface machining method. Thus, a desired aspherical reflecting mirror with a desired performance is realized while fabricated by the spherical surface machining method which is simple and accurate compared with the aspherical machining method. By utilizing this invention, it becomes possible to practically fabricate an X-ray aspherical reflecting device requiring a high shape accuracy.

While the invention has been described with reference to preferred embodiments thereof, it is to be understood that modifications or variations may be easily made without departing from the scope of the present invention which is defined by the appended claims.

What is claimed is:

1. An X-ray reflecting device comprising:

a reflecting mirror comprising an elastically deformable material;

a support member; and a means for applying an external force to an outer periphery or a rear surface of said reflecting mirror; wherein said elastically deformable material has a first spherical surface that maintains a spherical shape when no external force is applied to said reflecting mirror;

said support member supports said reflecting mirror and a space is provided between the rear surface of said reflecting mirror and said support member; and means for applying said external force to said reflecting mirror such that said reflecting mirror is deformed and said space remains after said deformation so as to obtain a desired aspherical reflecting surface.

2. The X-ray reflecting device as defined in claim 1, wherein said reflecting mirror has an aspherical surface.

3. The X-ray reflecting device as defined in claim 1, wherein said reflecting mirror has a second spherical surface, and the centers of said first spherical surface and said second spherical surface are deviated from each other.

4. The X-ray reflecting device as defined in claim 1, wherein the thickness of said reflecting mirror varies in a radial direction of said mirror.

5. The X-ray reflecting device as defined in claim 1, wherein the thickness of said reflecting mirror varies in a circumferential direction of said mirror.

6. The X-ray reflecting device as defined in claim 1, wherein compressed fluid is introduced into said space to apply said external force to said reflecting mirror.

7. The X-ray reflecting device as defined in claim 1, wherein a ring-like piezoelectric element is interposed between said outer periphery of said reflecting mirror and an inner periphery of said support member.

8. The X-ray reflecting device as defined in claim 1, wherein a plurality of piezoelectric elements are distributed in a circumferential direction of said mirror and between said outer periphery of said reflecting mirror and an inner periphery of said support member.

9. The X-ray reflecting device as defined in claim 1, wherein said support member has a pair of members interposing said reflecting mirror therebetween, wherein said paired members are connected to each other by a male screw provided on one member of said paired members and a female screw provided on the other member of said paired members, and wherein said reflecting mirror is deformed by varying a screw-in depth.

* * * * *